US008920223B2

(12) United States Patent
Meyer

(10) Patent No.: US 8,920,223 B2
(45) Date of Patent: Dec. 30, 2014

(54) COIN SORTER

(71) Applicant: Crane Payment Solutions GmbH, Buxtehude (DE)

(72) Inventor: Wilfried Meyer, Buxtehude (DE)

(73) Assignee: Crane Payment Solutions GmbH, Buxtehude (DE)

( * ) Notice: Subject to any disclaimer, the term of this patent is extended or adjusted under 35 U.S.C. 154(b) by 0 days.

(21) Appl. No.: 14/052,318

(22) Filed: Oct. 11, 2013

(65) Prior Publication Data

US 2014/0106656 A1 Apr. 17, 2014

(30) Foreign Application Priority Data

Oct. 15, 2012 (DE) ..... 10 2012 020 155

(51) Int. Cl.

| | |
|---|---|
| ***G07D 3/00*** | (2006.01) |
| ***G07D 3/02*** | (2006.01) |
| ***G07D 3/06*** | (2006.01) |
| ***G07D 9/00*** | (2006.01) |

(52) U.S. Cl.

CPC . *G07D 3/00* (2013.01); *G07D 9/008* (2013.01)
USPC ..... 453/3; 453/56

(58) Field of Classification Search

CPC ..... G07D 3/00; G07D 3/02; G07D 3/06
USPC ..... 453/9–12, 56, 6, 7, 13–15
See application file for complete search history.

(56) References Cited

U.S. PATENT DOCUMENTS 5,207,611 A * 5/1993 Ueda et al. ..... 453/11
2011/0189932 A1 8/2011 Adams et al.

FOREIGN PATENT DOCUMENTS

DE 41 23 549 A1 1/1992
DE 10152327 A1 5/2003

* cited by examiner

*Primary Examiner* — Mark Beauchaine
(74) *Attorney, Agent, or Firm* — Vidas, Arrett & Steinkraus, P.A.

(57) ABSTRACT

A coin sorter comprising a housing and a rotary disc arranged in the housing and rotatingly drivable by a rotary drive for coins to be sorted, the rotary disc is surrounded by a guide wall and a coin discharge area delimited by a wall section is provided, through which coins on the rotatingly driven rotary disc arrive at a coin conveyor track connecting to the coin discharge area, a rotatingly driven conveyor belt progressing in section above the rotary disc for conveying the coins along the coin conveyor track is arranged above the coin conveyor track, wherein the coin conveyor track is delimited by a guide edge, along which the coins are conveyed by the conveyor belt, wherein the bottom of the coin discharge area next to the wall section delimiting the coin discharge area has a discharge hole, through which the coins conveyed against the wall section can fall.

19 Claims, 1 Drawing Sheet

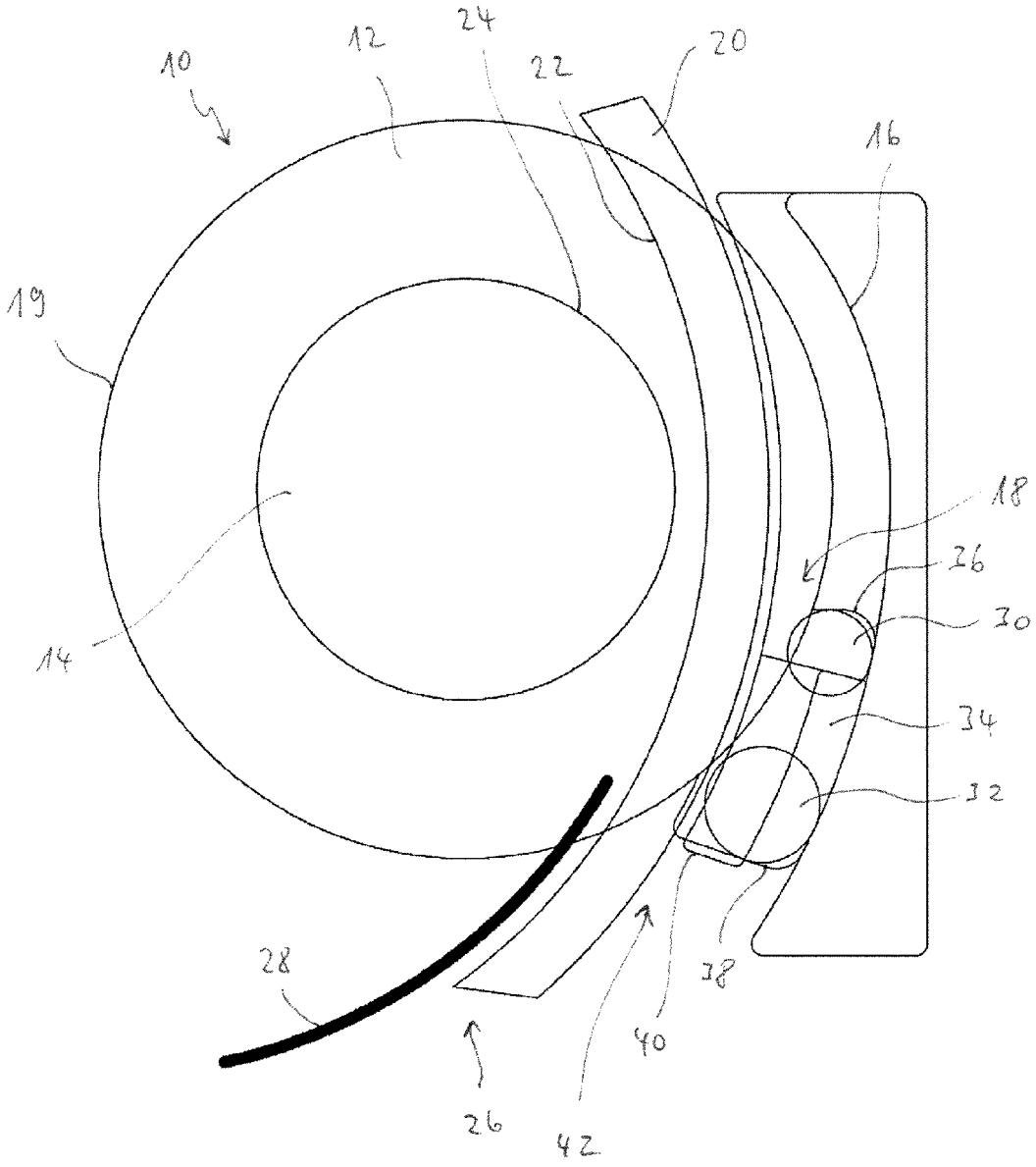
10
12
24
22
20
16
19
18
36
30
14
34
32
28
38
40
26
42

COIN SORTER

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The invention relates to a coin sorting device, comprising a housing and a rotary disc arranged in the housing and rotatingly drivable by means of a rotary drive for receiving a plurality of coins to be sorted with different diameters, wherein the rotary disc is surrounded at least in sections by a guide wall and wherein a coin discharge area delimited by a wall section is provided, through which coins located on the rotatingly driven rotary disc arrive at a coin conveyor track connecting to the coin discharge area, wherein a rotatingly driven conveyor belt for conveying the coins along the coin conveyor track is arranged above the coin conveyor track, wherein the coin conveyor track is delimited by a guide edge on its inside and/or its outside, along which the coins are conveyed by the conveyor belt.

Such a coin sorting device is normally also called a coin recycler. The coin sorting device has a coin intake, via which a plurality of unsorted coins can be supplied individually or together. From the coin intake, the coins make their way to the rotatingly driven rotary disc, which forms a so-called centrifuge. From the rotatingly driven rotary disk, the coins make their way under a conveyor belt and into a coin discharge area. The conveyor belt conveys the coins out of the coin discharge area along a coin conveyor track. Different areas are provided along the coin conveyor track, for example a coin check area and a coin sort area.

The coins should be conveyed by the conveyor belt along the coin conveyor track resting against the guiding edge. Also due to the different coin diameters to be processed, the coins under the conveyor belt are not always located on the guide edge of the coin conveyor track. While such position deviations cannot be avoided, they must not lead to errors. In particular, each coin put into the coin sorting device must be processed without intervention by personnel, i.e. either sorted in the desired manner or discharged from the coin sorting device through a corresponding return. In any case, it should be avoided that unprocessed coins remain in the coin sorting device.

If coins not resting against the guide edge are still conveyed by the conveyor belt along the coin conveyor track, it can be ensured through a suitable return that these are discharged from the coin sorting device. More problematic is the case when a coin in the coin discharge area is pushed through, for example by a subsequent coin below the conveyor belt, and thus loses contact with the conveyor belt and can remain lying on the side of the conveyor belt facing away from the rotary disc in the coin discharge area. In certain circumstances, such a coin is no longer conveyed out of the coin discharge area and could thus remain unprocessed in the coin sorting device.

Based on the explained state of the art, an object of the invention is to provide a coin sorting device of the initially named type, with which it is ensured that each inserted coin is reliably processed.

BRIEF SUMMARY OF THE INVENTION

The coin sorting device comprises a housing and a rotary disc arranged in the housing and rotatingly drivable by means of a rotary drive for receiving a plurality of coins to be sorted with different diameters, wherein the rotary disc is surrounded at least in sections by a guide wall and wherein a coin discharge area delimited by a wall section is provided, through which coins located on the rotatingly driven rotary disc arrive at a coin conveyor track connected to the coin discharge area, wherein a rotatingly driven conveyor belt for conveying the coins along the coin conveyor track is arranged above the coin conveyor track, wherein the coin conveyor track is delimited by a guide edge on its inside and/or its outside, along which the coins are conveyed by the conveyor belt, wherein the conveyor belt runs in sections above the rotary disc and the bottom of the coin discharge area next to the wall section delimiting the coin discharge area has a discharge hole, through which the coins conveyed against the wall section can fall, which were not caught by the conveyor belt or not caught completely.

As initially mentioned, the coin sorting device is a so-called coin recycler. One can generally divide such coin recyclers into two modules. A lower module of the coin recycler is formed by a coin storage unit and a coin payout module to the customers. This module normally comprises so-called hoppers, which can save and output coins. The hoppers normally have a payout disc and a container for coins. The paid out coins can then be transported for example through a transport belt or the like into a return or output dish. Here, the customer can receive the appropriate change. If necessary, this lower module can also comprise a coin register.

The upper module of the coin recycler is responsible for receiving the coins. In a money transaction or for example in a coin filling, coins are received, measured and sorted according to their value by the upper module. Foreign bodies, liquids or incorrect money should be rejected and real money should be sorted into the provided coin storage unit.

The invention concerns in particular such an upper module of a coin recycler. As mentioned above, coins are inserted individually or in larger amounts (as so-called bulk) into the coin sorting device through a coin inlet of the coin sorting device, where they make their way to the rotatingly driven rotary disc. The coin inlet area can be formed for example by an intake hopper. The rotating rotary disc working as a centrifuge moves the coins in succession under the conveyor belt in the coin discharge area. The coins are captured by the conveyor belt and conveyed further through the coin discharge area along the coin conveyor track. The conveyor belt consists of a material with high friction, e.g. caoutchouc, TPU, PU, rubber, etc. and has for example continuous lamellas, which can stand perpendicular or at an angle between 0° and 90° with respect to a carrier belt for the lamellas. The elastic lamellas ensure that coins with different diameters and different thicknesses can be securely conveyed by the conveyor belt. The conveyor belt also ensures that the coins are separated and thus conveyed in succession along the coin conveyor track.

The rotatingly driven rotary disc can be designed circularly, for example annularly. The coin conveyor track and the conveyor belt can also run circularly. In a generally known manner, at least one coin check area and at least one coin sorting area can be provided in the conveying direction of the coins subsequent to the coin discharge area along the coin conveyor track with the discharge hole. The coin check area can comprise one or more detectors for checking the passing coins. The coin sorting area can comprise e.g. a passive or active sorting of the coins, for example by means of several successively larger sorting holes arranged one after the other in the conveying direction of the coins.

As initially mentioned, it cannot always be ensured that the coins rest against the guide edge of the coin conveyor track in the course of conveyance along the coin conveyor track. However, as also initially explained, such coins, which do not rest against the guide edge, but which are conveyed properly by the conveyor belt, can be supplied to a coin return via a corresponding return opening. Problematic are coins, which are for example pushed by a subsequent coin under the conveyor belt against the wall section of the coin discharge area and thus out of the collection area of the conveyor belt and potentially remain there. The invention thus provides a discharge hole in the bottom of the coin discharge area next to the wall section delimiting the coin discharge area. Coins conveyed or pushed against the wall section, which were not captured by the conveyor belt or not sufficiently captured for further transport along the coin conveyor track, can fall through this discharge hole in the described manner. It is therefore ensured that no coins can remain unprocessed in the coin sorting device, in particular in the coin discharge area. Rather, all coins inserted into the coin sorting device are processed, i.e. either fed to a coin return or sorted into a coin storage unit or the like. This is achieved in a simple manner in that coins, which have lost contact with the conveyor belt, fall downwards through the discharge hole and are fed for example to a coin return.

The coin conveyor track and the conveyor belt can run eccentrically to the rotary disc. The coin conveyor track and the conveyor belt can thereby have a larger diameter than the rotary disc. Furthermore, the guide edge of the coin conveyor track can have a spiral progression such that it approaches the conveyor belt in the conveying direction of the coins. Through this embodiment, a particularly compact structure of the coin sorting device is achieved with simultaneously secure guiding of the coins along the coin conveyor track.

According to a further embodiment, the rotary disc can have a circular middle part delimited by an annular disc area and elevated with respect to the bottom of the annual disc area, wherein the middle part is also rotatingly drivable or fixed. The middle part can be rotatingly driven by the same rotary drive as the annular disc area or independently of it. However, it can also be designed fixed. Coins located on the rotatingly driven rotary disc hit the elevated middle part in the course of their conveyance through the rotary disc so that the middle part conveys the coins e.g. together with a wall section of the coin discharge area under the conveyor belt and thus out of the rotary disc. For this, the coin discharge area can be designed wedge-shaped at least in sections, wherein a wall of this wedge can be formed by the inner flank of the conveyor belt and the other by the middle part of the rotary disc. A coin reaching this wedge-shaped coin discharge area is captured by the inner flank of the conveyor belt and pushed against the opposite-lying side of the middle part of the rotary disc. On the middle part, the coin then rolls off, wherein it is pushed further under the conveyor belt as a result of the tapering wedge. In order to prevent two or more coins lying on top of each other from thereby getting pushed under the conveyor belt, the height of the middle part relative to the bottom of the annular disc area of the rotary disc can be restricted to a height that is lower than the thinnest coin to be sorted.

The rotary disc can run in sections through the coin discharge area and namely below the conveyor belt. According to a further embodiment, the discharge hole can extend in an area between the wall section of the coin discharge area and the rotary disc running in sections through the coin discharge area. Accordingly, the discharge hole can extend in sections below the conveyor belt. According to a further embodiment, the coin discharge area can have a through hole for coins conveyed out of the coin discharge area along the coin conveyor track, the width of which mainly corresponds with the diameter of the largest coin to be sorted, in particular only slightly larger than the diameter of the largest coin to be sorted so that it can just make it through the through hole. Furthermore, according to one embodiment, the discharge hole has a size that permits the falling through of coins only up to a threshold diameter. This threshold diameter can correspond with the difference between the diameter of the largest coin to be sorted and the smallest coin to be sorted. Furthermore, the conveyor belt can have a width that mainly corresponds with the diameter of the smallest coin to be sorted. For example, the coin sorting device can be designed for the sorting of coins in a diameter range of 14 mm to 33 mm. The entire worldwide coin spectrum is thereby covered so that the coin sorting device according to the invention can be used without restrictions.

In the case of the aforementioned diameter range of the coins to be processed with the coin sorting device according to the invention, the through hole must have a width of at least 33 mm in order to also permit passage of the largest coins. A critical area between the wall section delimiting the coin discharge area and the conveyor belt for possible unprocessed coins cannot thereby be avoided. In particular, the wall section delimiting the coin discharge area cannot be pushed closer to the opposite-lying guide edge. For example, applied to the aforementioned diameter range, there would be a distance of at least 19 mm between the conveyor belt and the wall section delimiting the through hole of the coin discharge area and thus an area for coins with a diameter between 14 mm and 19 mm, which could theoretically remain unprocessed in the coin sorting device. A part of this problematic area can also be covered by the rotary disc so that no coins remain lying in this area. The critical area for the coins remaining in the coin sorting device is thus defined and this area can be fully designed as a discharge hole, where applicable. It is generally advantageous when the discharge hole is dimensioned slightly larger than the correspondingly described critical area, for example approx. 1 mm wider. It is hereby achieved that those coins that were just barely captured by the conveyor belt also fall into the discharge hole so that the reliable further transport is ensured for the remaining coins.

According to a further embodiment, a pressing element can be provided above the discharge hole, which is designed to push coins not captured or not completely captured by the conveyor belt up to the threshold diameter through the discharge hole and to let through coins above the threshold diameter. The pressing element can be a leaf spring, for example. In the coin sorting device, the coins move for example in the coin discharge area normally with speeds of approx. 1 mm/ms. If they were conveyed over the discharge hole by gravity alone, they would free fall into the discharge hole, that is downwards only approx. 5 μm in the course of the first millimeter of transport path (the following applies: $s=\frac{1}{2}*g*t^2$, with s: path, g: gravity acceleration, t: time). The coins can thereby get over the discharge hole and then remain unprocessed in the coin sorting device. This problem is securely solved by the pressing element, which correspondingly pushes coins not captured by the conveyor belt into the discharge hole, but lets (larger) coins conveyed by the conveyor belt pass along the coin conveyor track.

According to a further embodiment, the discharge hole can be connected with a coin return and/or at least one coin storage unit so that coins falling through the discharge hole make their way to the coin return or to the at least one coin storage unit. A transport device can be provided, which is designed to transport coins that have fallen through the discharge hole to the coin return or to the at least one coin storage unit. It is possible that due to constructive requirements the discharge hole cannot be arranged above a coin return of the coin sorting device, rather for example above a coin storage unit for the sorted coins determined to be genuine. In particular in compact coin sorting devices, the available installation space does not always allow for a path to the coin return for example via a sloped plane (chute). Thus, a transport device can be provided, which actively transports coins that have fallen through the discharge hole to the coin discharge, for example. The transport device can comprise a transport belt, for example. But it is also conceivable that the transport device comprises at least one transport rotary disc rotatingly drivable in a plane below the rotary disc. A second centrifuge is thus provided on a second lower plane, in particular at the height of the bottom level of the discharge hole. Through this second centrifuge, coins that have fallen through the discharge hole can then be transported to a coin return or the like provided at a different location in the coin sorting device.

BRIEF DESCRIPTION OF THE DRAWING

FIG. 1 is a partially transparent top view showing in sections and schematically a coin sorting device of the invention.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

An exemplary embodiment of the invention is explained in greater detail below with reference to a FIGURE. The one FIGURE shows in sections and very schematically a coin sorting device according to the invention in a partially transparent top view.

The coin sorting device has a housing not shown in the FIGURE with a coin inlet area, for example in the form of an intake hopper (also not shown). Moreover, a rotary disc 10 rotatingly drivable by means of a rotary drive (not shown) for receiving a plurality of coins to be sorted with different diameters is arranged in the housing. The rotary disc 10 has an annular disc area 12 and a circular middle part 14 delimited by the disc area 12 and elevated relative to the bottom of the disc area 12. The middle part 14 can also be rotatingly drivable or fixed. In the example shown, the rotary disc 10 is rotatingly driven clockwise. Reference number 16 shows a wall section that forms a boundary of a coin discharge area 18. On the side opposite the coin discharge area 18, the rotary disc 10 is surrounded in sections by a guide wall 19. Through the rotary disc 10 working as a centrifuge, conveyed coins make their way under a conveyor belt 20 only shown in sections in the FIGURE. In particular, the coins are pushed by the rotary disc 10 on one hand against the inner flank 22 of the conveyor belt 20 and on the other hand against the associated edge 24 of the middle part 14. The flank 22 and the edge 24 form a wedge-shaped inlet of the coin discharge area 18. In particular, the coins are captured by lamellas provided on the bottom side of the conveyor belt 20 and taken along into the coin discharge area 18. It can be seen in the FIGURE that the conveyor belt 20 progresses in sections above the rotary disc 10. An also circular coin conveyor track 26 for the coins runs below the conveyor belt 20 rotatingly driven along a circular path. The coin conveyor track 26 is delimited in the example shown on its inside by a guide edge 28 shown only in sections in the FIGURE, along which the coins from the conveyor belt 20 are conveyed along the coin conveyor track. For example, generally known coin check areas and coin sorting areas can follow along the coin conveyor track 26. As can also be seen in the FIGURE, the coin conveyor track 26 and the conveyor belt 20 have a greater diameter than the rotary disc 10 and are arranged eccentrically to the rotary disc 10. The guide edge 28 of the coin conveyor track 26 can have a spiral progression such that it approaches the conveyor belt 20 in the conveying direction of the coins.

As shown in the FIGURE as an example for a first coin 30 with a small diameter, for example a diameter of 14 mm, and a second coin 32 with a larger diameter, for example a diameter of 19 mm, it is possible that coins are pushed for example by subsequent coins under and through the conveyor belt 20 into an area of the coin discharge area 18 between the wall section 16 and the outer flank of the conveyor belt 20. Since they also make their way into an area outside the rotary disc 10, it should be prevented that these coins 30, 32 can remain unprocessed in this dead zone in the coin sorting device. For this, a discharge hole shown with reference number 34 is provided in the bottom of the coin discharge area 18 between the wall section 16 and the rotary disc 10 or respectively the conveyor belt 20. A front end of the discharge hole 34 as seen in the conveying direction of the coins 30, 32 is shown with reference number 36; a rear end of the discharge hole 34 as seen in the conveying direction of the coins 30, 32 is shown with reference number 38. In the example shown, the discharge hole 34 extends on its one side up to the wall section 16 and is delimited on the opposite side by the corresponding sections of the rotary disc 10 or respectively the conveyor belt 20 between the front and rear end 36, 38. Moreover, as can be seen in the FIGURE, the discharge hole 34 thereby extends slightly below the conveyor belt 20.

Moreover, reference number 40 shows an elastic pressing element arranged above the discharge hole 34, here a leaf spring 40. As can be seen in the FIGURE, the coins 30, 32 pushed under and through the conveyor belt 20 make their way below the leaf spring 40 into the area of the discharge hole 34. The discharge hole 34 has a size, which is sufficient for a falling through of the coins 30, 32 shown in the FIGURE. The leaf spring 40 pushes the coins 30, 32 into the discharge hole, through which they fall, for example to a coin return (not shown) or a coin storage unit (not shown). In the example shown, the discharge hole 34 has a size which permits the falling through of coins up to a threshold diameter which corresponds with the difference between the largest coin to be sorted and the smallest coin to be sorted. In the FIGURE, reference number 42 indicates a through hole of the coin discharge area 18 for coins conveyed further out of the coin discharge area 18 along the coin conveyor track 26. The through hole 42 is delimited on one side by the lower end of the wall section 16 in the FIGURE and on the other side by the guide edge 28. This through hole 42 must have a sufficient size so that the largest coin to be sorted with the coin sorting device can pass through the through hole 42. The through hole 42 is preferably only insignificantly larger than the diameter of this largest coin to be sorted. For example, the coin sorting device shown in the FIGURE can be designed for the sorting of coins in a diameter range of 14 mm to 33 mm.

The discharge hole 34 according to the invention ensures that no coins can remain in the coin discharge area 18 without being processed. Coins that cannot fall into the discharge hole 34 due to their diameter are securely transported by the conveyor belt 20 and conveyed along the coin conveyor track 26.

At the same time, the coin sorting device according to the invention has a compact structure.

This completes the description of the preferred and alternate embodiments of the invention. Those skilled in the art may recognize other equivalents to the specific embodiment described herein which equivalents are intended to be encompassed by the claims attached hereto.

What is claimed is:

1. A coin sorting device, comprising:

a housing and a rotary disc (10) arranged in the housing and rotatingly drivable by means of a rotary drive for receiving a plurality of coins (30, 32) to be sorted with different diameters, wherein the rotary disc (10) is surrounded at least in sections by a guide wall (19) and wherein a coin discharge area (18) delimited by a wall section (16) is provided, through which coins (30, 32) located on the rotatingly driven rotary disc (10) arrive at a coin conveyor track (26) connecting to the coin discharge area (18), wherein a rotatingly driven conveyor belt (20) for conveying the coins (30, 32) along the coin conveyor track (26) is arranged above the coin conveyor track (26), wherein the coin conveyor track (26) is delimited by a guide edge (28) on its inside and/or its outside, along which the coins (30, 32) are conveyed by the conveyor belt (20), wherein the conveyor belt (20) runs in sections above the rotary disc (10), and in that the bottom of the coin discharge area (18) next to the wall section (16) delimiting the coin discharge area (18) has a discharge hole (34), through which coins (30, 32) conveyed against the wall section (16), which were not captured or not completely captured by the conveyor belt (20), can fall.

2. The coin sorting device according to claim 1, wherein the coin conveyor track (26) and the conveyor belt (20) run eccentrically to the rotary disc (10).

3. The coin sorting device according to claim 1, wherein the coin conveyor track (26) and the conveyor belt (20) have a larger diameter than the rotary disc (10).

4. The coin sorting device according to claim 1, wherein the guide edge (28) of the coin conveyor track (26) has a spiral progression such that it approaches the conveyor belt (20) in the conveying direction of the coins (30, 32).

5. The coin sorting device according to claim 1, wherein the rotary disc (10) has a circular middle part (14) delimited by an annular disc area (12) and elevated with respect to the bottom of the annual disc area (12), wherein the middle part (14) is also rotatingly drivable or fixed.

6. The coin sorting device according to claim 1, wherein the discharge hole (34) extends in an area between the wall section (16) and the rotary disc (10) progressing in sections through the coin discharge area (18).

7. The coin sorting device according to claim 1, wherein the discharge hole (34) extends in sections below the conveyor belt (20).

8. The coin sorting device according to claim 1, wherein the coin discharge area (18) has a through hole (42) for coins (30, 32) conveyed out of the coin discharge area (18) along the coin conveyor track, the width of which mainly corresponds with the diameter of the largest coin (30, 32) to be sorted.

9. The coin sorting device according to claim 1, wherein the conveyor belt (20) has a width, which mainly corresponds with the diameter of the smallest coin to be sorted.

10. The coin sorting device according to claim 1, wherein it is designed for the sorting of coins (30, 32) in a diameter range of 14 mm to 33 mm.

11. The coin sorting device according to claim 1, wherein at least one coin check area and at least one coin sorting area are provided in the conveying direction of the coins (30, 32) along the coin conveyor track (26) prior to the discharge hole (34).

12. The coin sorting device according to claim 1, wherein the discharge hole (34) has a size, which only permits the falling through of coins (30, 32) up to a threshold diameter.

13. The coin sorting device according to claim 12, wherein the threshold diameter corresponds with the differences between the diameter of the largest coin to be sorted and the smallest coin to be sorted.

14. The coin sorting device according to claim 12, wherein a pressing element (40) is provided above the discharge hole (34), which is designed to push coins (30, 32) not captured or not completely captured by the conveyor belt (20) up to the threshold diameter through the discharge hole (34) and to let through coins (30, 32) above the threshold diameter.

15. The coin sorting device according to claim 14, wherein the pressing element (40) is a leaf spring.

16. The coin sorting device according to claim 1, wherein the discharge hole (34) is connected with a coin return and/or at least one coin storage unit so that coins (30, 32) falling through the discharge hole (34) make their way to the coin return or to the at least one coin storage unit.

17. The coin sorting device according to claim 16, wherein a transport device is provided, which is designed to transport coins (30, 32) that have fallen through the discharge hole (34) to the coin return or to the at least one coin storage unit.

18. The coin sorting device according to claim 17, wherein the transport device comprises a transport belt.

19. The coin sorting device according to claim 17, wherein the transport device comprises at least one transport rotary disc rotatingly drivable in a plane below the rotary disc (10).

* * * * *